United States Patent [19]

Rueblinger

[11] Patent Number: 4,483,112

[45] Date of Patent: Nov. 20, 1984

[54] ROOF EDGE SYSTEM

[75] Inventor: Carl R. Rueblinger, Marlton, N.J.

[73] Assignee: Henry E. Millson, Jr., Medford, N.J. ; a part interest

[21] Appl. No.: 329,710

[22] Filed: Dec. 11, 1981

[51] Int. Cl.[3] ..... E04D 13/15

[52] U.S. Cl. ..... 52/94; 52/58

[58] Field of Search ..... 52/58–62, 52/94, 769, 770, 371, 94, 58

[56] References Cited

U.S. PATENT DOCUMENTS

| | | | |
|---|---|---|---|
| 1,712,202 | 5/1929 | Eggers | 52/371 X |
| 1,873,350 | 8/1932 | Smith | 52/770 |
| 2,168,204 | 8/1939 | Hanson | 52/60 |
| 2,974,448 | 3/1961 | Weis | 52/60 |
| 3,090,085 | 5/1963 | Brown | 52/769 X |
| 3,365,847 | 1/1968 | Josek | 52/58 X |
| 3,389,515 | 6/1968 | Hillebrand | 52/94 |
| 3,405,485 | 10/1968 | Edwards | 52/60 |
| 3,503,162 | 3/1970 | Ward | 52/60 |
| 3,533,201 | 10/1970 | Tyler | 52/60 |
| 3,585,766 | 6/1971 | Jamieson | 52/60 |
| 3,738,068 | 6/1973 | Attaway | 52/60 |
| 3,992,827 | 11/1976 | Johnson | 52/60 |
| 4,067,152 | 1/1978 | Wolma | 52/60 |
| 4,071,987 | 2/1978 | Hickman | 52/94 |
| 4,241,549 | 12/1980 | Hall et al. | 52/60 |

FOREIGN PATENT DOCUMENTS

| | | | |
|---|---|---|---|
| 222323 | 7/1962 | Austria | 52/769 |
| 2060292 | 6/1972 | Fed. Rep. of Germany | 52/60 |
| 2252770 | 5/1974 | Fed. Rep. of Germany | 52/94 |
| 2255950 | 5/1974 | Fed. Rep. of Germany | 52/94 |
| 2256098 | 5/1974 | Fed. Rep. of Germany | 52/94 |
| 2632032 | 1/1978 | Fed. Rep. of Germany | 52/94 |

OTHER PUBLICATIONS

Architectural Products Co., Fascia System Type TE and Galvanized Water Dam–Specification Sheet.

W. P. Hickman Co., Econosnap Extruded Roof Edge System–Specification Sheet.

FM Research Corporation, Drip–Proof Fascia and Cant Dam System–Specification Sheet.

*Primary Examiner*—Alfred C. Perham

*Attorney, Agent, or Firm*—Henry E. Millson, Jr.

[57] ABSTRACT

An edge structure for a flat roof comprising a cant, a fascia member, and a deformable pressure clip held in a compressed relationship between the cant and the fascia member.

19 Claims, 8 Drawing Figures

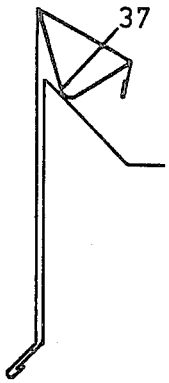
Fig-5
Fig-6
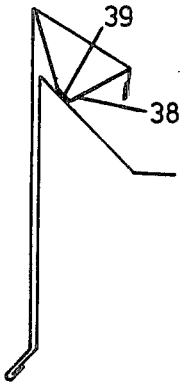
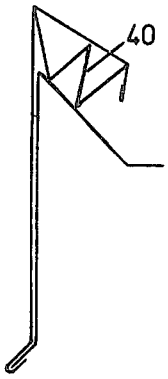
Fig-7
Fig-8
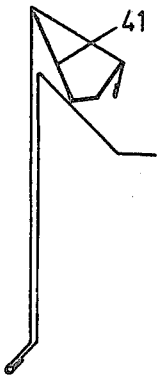

ROOF EDGE SYSTEM

FIELD OF THE INVENTION

This invention is directed to a roof edge system for edging and fastening the waterproof roofing membranes that are currently used to cover and protect roof substructures on non-residential buildings. In the development of the art covering the substructure of flat roofs, tar paper and asphalt (tar) coverings were at one time standard in the industry. In recent times, these coverings have been replaced by single ply waterproof membranes, e.g. rubber or plastic sheets, that are easy to install, relatively inexpensive, and more durable than either the tar paper or asphalt coverings.

One problem that arose with the advent of the waterproof membranes was how to fasten the membranes in a secure manner at the edges of the roof. The present invention is directed to a novel system for securing the edges of the membrane without piercing the membrane with fastening screws or by sharp edges of components frequently used in prior art fastening systems. The present system is inexpensive to manufacture and easy to install.

BACKGROUND ART

The following prior art United States patents are all directed to edging systems for edging roofs.

| U.S. Pat. No. | Issue Date | Title |
|---|---|---|
| 3,405,485 | 10/15/68 | Flashing Systems for Flat Roofs |
| 3,503,162 | 3/31/70 | Combination Water Cant, Sealer Strip & Fascia |
| 3,533,201 | 10/13/70 | Fascia and Flashing Construction |
| 3,585,766 | 6/22/71 | Flashing Construction |
| 3,738,068 | 6/12/73 | Conjoint Fascia and Water Dam |
| 3,992,827 | 11/23/76 | Coping Assembly with Deformable Seal Clamp |
| 4,067,152 | 1/10/78 | Fascia Compression Clip |
| 4,071,987 | 2/7/78 | Gravel Stop |
| 4,241,549 | 12/30/80 | Conjoint Fascia, Flashing and Water Dam |

Also, the following specification sheets are currently circulated for commercially available edging systems.

| Company | Title |
|---|---|
| Architectural Products Co. | Fascia System Type TE and Galvanized Water Dam |
| W. P. Hickman Co., Inc. | Econosnap Extruded Roof Edge System |
| FM Research Corporation | Drip-Proof Fascia and Cant Dam Systems |

With respect to the above art, U.S. Pat. No. 3,405,485 discloses a roof flashing system for use with tar coated roofs. This system is expensive to manufacture and install, requiring a large number of relatively complicated parts, including two wooden supports that must be accurately cut and then installed.

U.S. Pat. No. 3,503,162 discloses a combination water dam, sealer strip and fascia edge structure for a flat roof having a built-up roofing material with a plurality of roofing plies. The sealer strip is secured with machine screws which are time consuming for the roofers to install, and which penetrate the roofing material, allowing water leakage around the screw holes as the screws loosen or the washers deteriorate. This system would not be satisfactory for use with a single ply membrane, due to leakage problems aggravated by tearing of the membrane around the screws due to contraction and expansion of the membrane with temperature changes in the weather.

U.S. Pat. No. 3,533,201 discloses a system for built-up roofs that has the same disadvantages as the system described in U.S. Pat. No. 3,503,162.

U.S. Pat. No. 3,585,766 discloses another system for use with built-up roofs only. This system uses a relatively large number of components including a wooden support that must be cut to shape, resulting in excessive manufacturing expense and installation cost. This system could not be used with a single ply membrane in any event, since the sharp edges of the cant would cut the membrane.

U.S. Pat. No. 3,738,068 utilizes a conjoint fascia and water dam. The system is relatively complicated, and both the fascia and water dam must be made by an extrusion process, a much more expensive process than the forming of the components from metal sheets. Also, extruded metal components cannot be prepainted, whereas metal sheets can be prepainted prior to the forming operation. The system also requires the use of machine screws through the fascia to fasten the system in place, a time consuming procedure for the roofer and an extra complication and expense in threading the holes for the screws in the manufacture of the fascia.

U.S. Pat. No. 3,992,827 is an edging system for roofs having parapet walls, i.e. the system cannot be used with flat roofs.

U.S. Pat. No. 4,067,152 discloses an edging system using a fascia compression clip. The fascia must be manufactured by extrusion, a much more expensive process than forming the fascia from sheet metal. The fascia clip has a deformable junction that is necessarily thin and hence relatively weak. The roofing membrane does not go over the top of the cant, so that water build-up and leakage under the compression clip could result in leakage under the membrane, causing rotting of the roof substructure. Also, the fascia clips are made into two foot sections with notches between, allowing rain water to accumulate under the fascia clips, markedly increasing the chance of metal corrosion. In addition, this system requires an extra sheet of material on the surface of the cant to block water penetration, an extra expense in manufacture and installation.

U.S. Pat. No. 4,071,987 discloses a roof edging system having a fascia member and a spring cant between which a roofing membrane is compressed. However, the top of the spring cant has sharp edges at the compression points, subjecting the membrane to possible severing during installation of the system or from wear due to expansion and contraction of both the metal components and the membrane itself. In addition, the membrane is bent 180° in the compression area, accelerating penetration and causing cracking of the membrane with aging. Also, this system requires either (a) the use of adhesive to secure the spring cant to the top edge of the building, a time consuming and messy procedure, and requires the spring cant to be formed with numerous holes through which the adhesive may penetrate to assist in holding the cant to the roof, or (b) the spring cant may be fastened to the top of the roof with nailing "fingers", a relatively expensive manufacturing operation. A further problem with this system is that, due to the varied thickness of roofing membranes, the top edge of the fascia must be fabricated for a particular thickness of membrane, reducing the versatility of the system for use with other thicknesses of roofing membranes. If used inadvertently with, e.g. a thinner membrane, water will become trapped between the fascia and the cant, causing accelerated corrosion problems. Furthermore, if pressure is applied to the slope of the cant, such as by a maintenance worker inadvertently stepping on the cant, the fascia will probably become disengaged from the cant.

U.S. Pat. No. 4,241,549 is directed to conjoint fascia, flashing and water dam. This system suffers from many of the disadvantages inherent in that disclosed in U.S. Pat. No. 4,071,987 above, i.e. the membrane is bent at a 180° angle, and the lack of versatility of the system for differing membrane thicknesses. Also, the fascia edge has a lower flashing lip, resulting in a sharp edge pressing against the membrane, which will abrade and eventually penetrate the membrane on contraction and expansion of the metal fascia.

Architectural Products Co. Specification Sheet - this system utilizes a fascia and a water dam (cant) wherein the roofing membrane is bent at a 180° angle over the sharp edges of the top of the cant, permitting severing of the membrane on installation or after contraction and expansion of the membrane and the metal components. Also, the fascia is formed by extrusion, an expensive process. Furthermore, the inward lip of the fascia exposes the locking mechanism to wind pressures that in severe storms could result in disconnecting of the fascia from the cant. In addition, stones and debris can lodge under the fascia lip, resulting in accelerated wearing of the membrane upon expansion and contraction of the metal components and membrane.

W. P. Hickman Co. Specification Sheet - this system is based on the disclosure of U.S. Pat. No. 4,071,987, discussed above. In addition, the spring clip is formed with a sharp edge that presses against the membrane, with wear and penetration liability that exists on installation and during use. In the event the membrane is cut, water can seep inside the spring clips, causing their erosion. Furthermore, this system requires the separate nailing of the membrane to the outside section of the roof, which is time consuming on installation. Also, the fascia member is extruded, an expensive process. A further disadvantage of this system is that the spring clip has an "open" design, which is not very strong structurally, and which may result in the spring clip being bent out of shape during its installation. Additionally, in the event the roofing membrane is ripped, wind under the ripped membrane may cause enough pressure on the system to uncouple the fascia from the cant. Furthermore, if pressure is applied to the slope of the cant, the fascia will probably become disengaged from the cant.

FM Research Corporation Specification Sheet - this system appears to be that disclosed in U.S. Pat. No. 3,738,068, and the comments relating to that patent are equally applicable to the system shown in this flyer.

BRIEF DESCRIPTION OF THE DRAWINGS

FIGS. 5 through 8 show alternate configurations of the pressure clip.

DETAILED DESCRIPTION OF THE INVENTION

Figure 1:
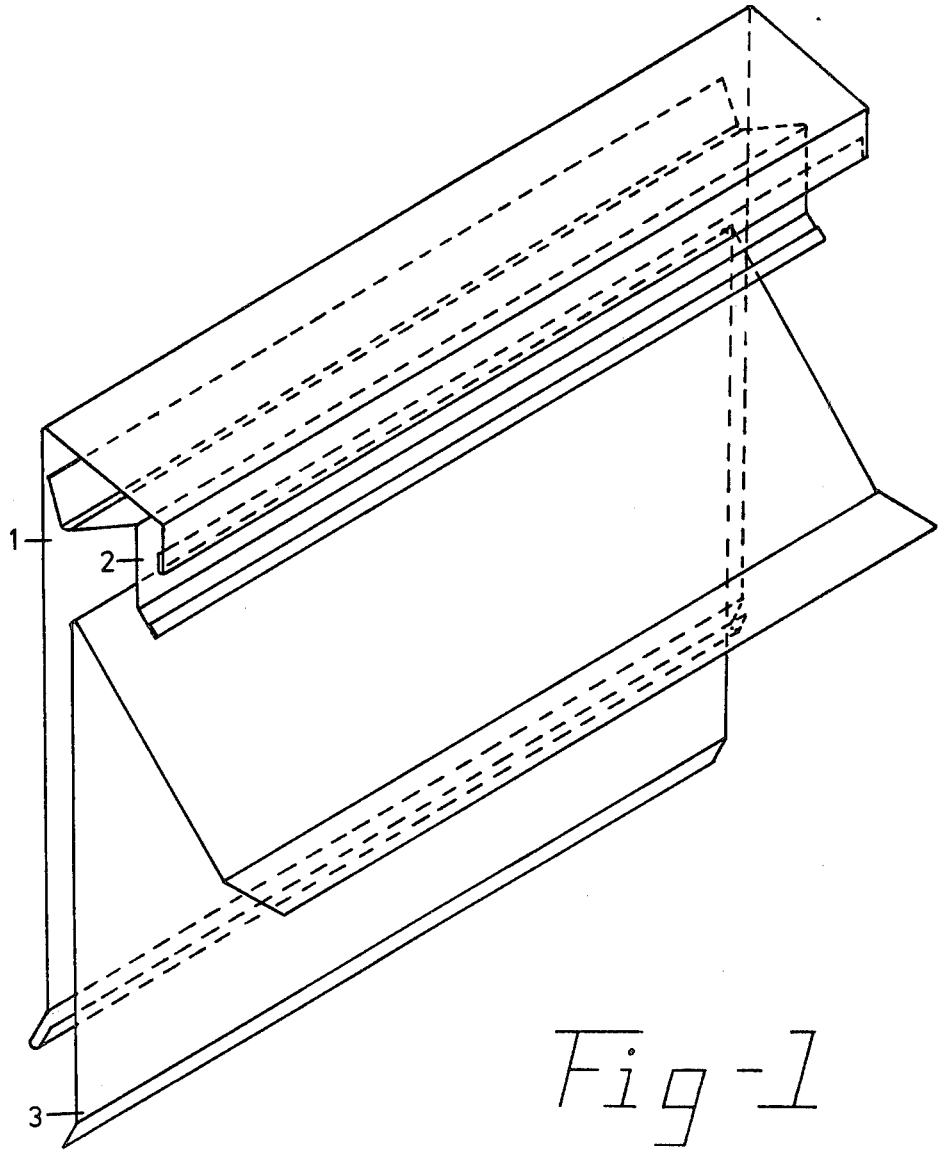
FIG. 1 is an exploded view of the fascia member, pressure clip, and cant comprising the roof edge system of the invention.

The present invention relates to a roof edging system for flat roofs covered with a single ply waterproof membrane comprising a fascia member, a cant, and a deformable pressure clip which is held in a compressed relationship between the fascia member and the cant.

This system has numerous important advantages over prior art systems including those currently in commercial use. Such advantages include the following:

1. No penetration of the waterproof membrane caused by screws or other fastening devices.
2. No sharp edges on any of the components of the system that are in contact with the membrane, so that no severing or abrasion of the membrane can occur, either during installation or thereafter.
3. The system does not require the membrane to be bent at an extreme angle, which would accelerate severing or cracking upon aging of the membrane.
4. No mechanical fasteners of any type are required for the installation of the exposed component, thus eliminating the problem and expense of forming slotted holes, the labor involved in securing the mechanical fasteners during installation, and loosening of the mechanical fasteners during use from different rates of expansion and contraction of the system components (since the fascia member is normally aluminum while the cant is normally made from galvanized steel).
5. The waterproof membrane is held firmly in place by the pressure clip and cannot pull back or work loose, yet the system allows for creepage of the membrane due to contraction and expansion with changes of temperature.
6. All three components of the present system are readily and inexpensively manufactured by forming (bending) metal sheets. No extruded parts are required.
7. The system is easily and quickly installed simply by applying downward pressure on the fascia member to compress the pressure clip and lock the bottom of the fascia onto the bottom of the cant.
8. No carpentry is required prior to installation of the system, i.e. no wooden blocks are needed as support for the system.
9. The pressure clip acts as counter flashing to prevent water and debris from wedging between the membrane and the top of the fascia member.
10. The system will not become uncoupled from wind pressure, since only a direct downward force can apply enough pressure to the presure clip to uncouple the system.
11. The system is readily uncoupled for repairs by administering direct downward pressure on the fascia member.
12. The system includes locking fascia cover plates that cover the joints between lengths of fascia, further ensuring that the system is waterproof.
13. Different metals can be used to form the different components of the system since differences in expansion and contraction rates of the components have no meaningful affect on the functioning of the system.

Referring now to the drawings,

FIG. 1 is an exploded view of fascia member 1, deformable pressure clip 2, and cant 3.

Figure 2:
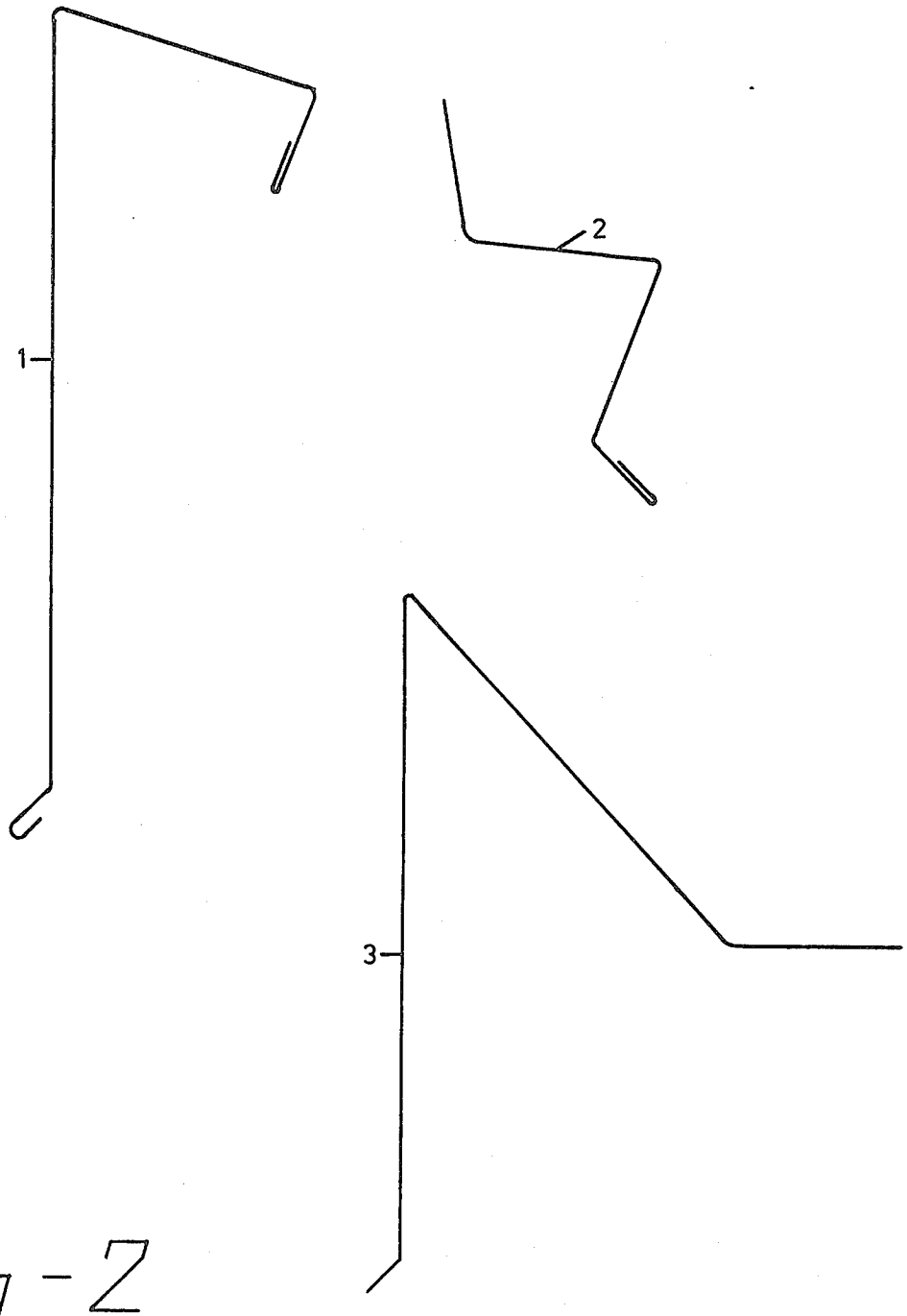
FIG. 2 is a transverse sectional view of the fascia member 1, pressure clip 2, and cant 3.

FIG. 2 shows a transverse sectional view of fascia member 1, deformable pressure clip 2, and cant 3.

Fascia member 1 shown in FIGS. 1 and 2 can be readily formed from a sheet of prepainted aluminum or aluminum alloy. Conveniently, 0.050" gauge thickness is used. Fascia member 1 can also be manufactured from any plastic material having the necessary resiliency and durability; or may be formed from galvanized steel, or from nickel or chromium plated steel, although the latter two materials are needlessly expensive.

Deformable pressure clip 2 shown in FIGS. 1 and 2 can be formed from galvanized steel, conveniently 20 gauge. Other materials can also be used such as an aluminum alloy, or nickel or chromium plated steel, but such materials are more expensive than galvanized steel.

Cant 3 shown in FIGS. 1 and 2 is preferably formed from galvanized steel, e.g. 20 gauge thickness. Other materials that can be employed are heavy gauge aluminum, and plastics if rigid and of great tensile strength.

Fascia members, compression clips and cants are normally formed in lengths of from about 8' to about 14', with 8', 10' or 12' sections most convenient for commercial uses.

Figure 3:
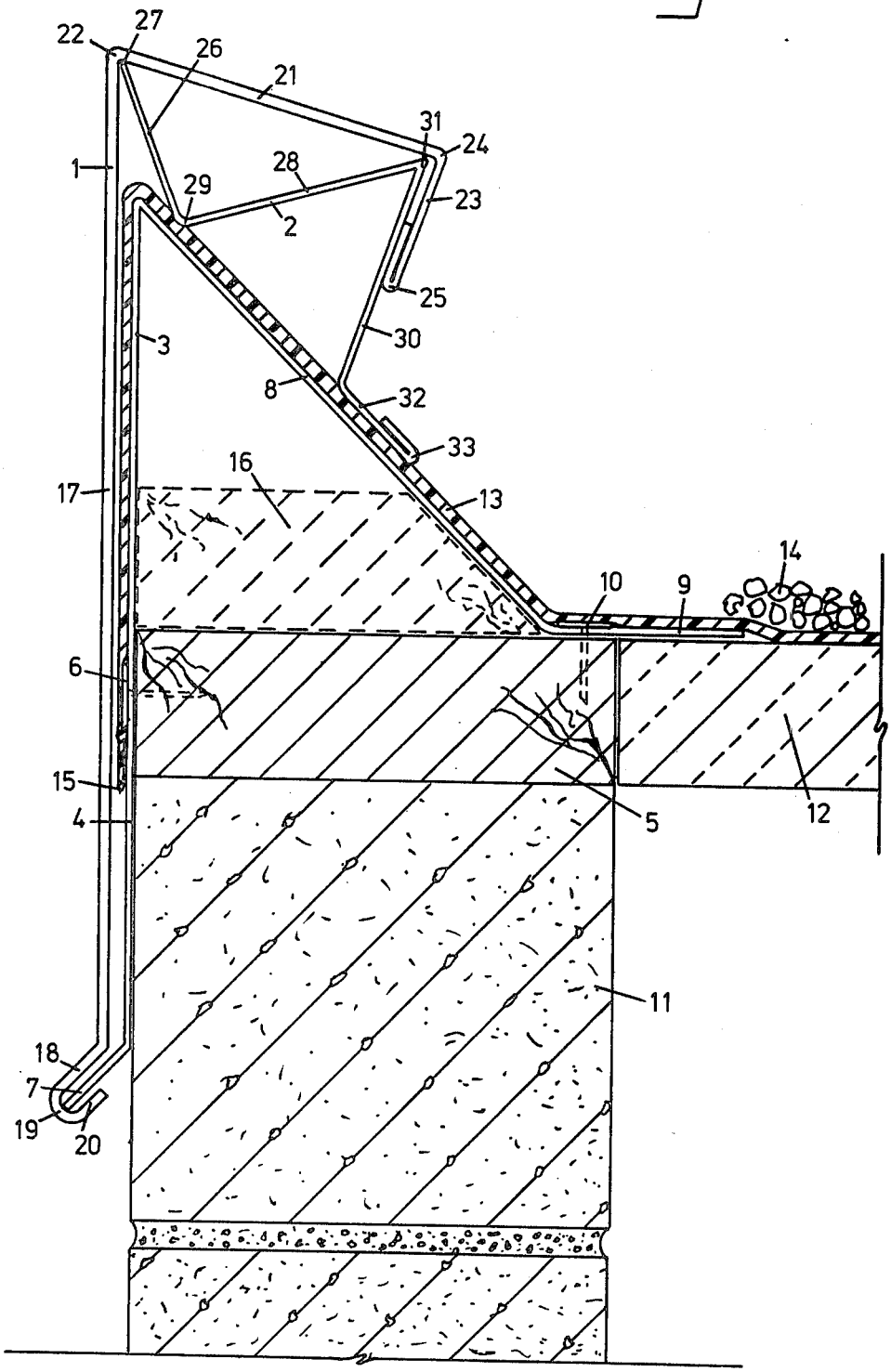
FIG. 3 is a transverse sectional view showing an installation of the roof edge system of the invention.

FIG. 3 is a transverse sectional view showing an installation of the roof edge system of the invention with a single ply waterproof membrane on a flat roof substructure.

In FIG. 3, cant 3 comprises an outer vertical portion or leg 4 which is secured to the outer side of the roofing deck 2"×4", 5, by any suitable means, such as by a plurality of 1" long galvanized roofing nails 6. The nails 6 may be positioned at any desired center spacings, e.g. at 2' center spacings. Cant 3 further includes an integral downwardly and outwardly inclined flange or "kick-out" 7 on the lower end of vertical leg 4. Cant vertical leg 4 extends above the roofing deck 2"×4", 5, for a predetermined distance, e.g. 3" to 6", as desired. Cant vertical leg 4 terminates at its upper end in an integral downwardly and inwardly facing leg portion 8. Leg portion 8 forms an acute angle, preferably an angle of about 45°, with vertical leg 4. Integrally formed on the lower end of leg portion 8 is a horizontal flange or extension 9 which is adapted to be secured to the roofing deck 2'×4', 5, by any suitable means such as by a plurality of 1" galvanized roofing nails 10 which are disposed at predetermined center to center distances, such as 12". Flange 9 is formed to be substantially perpendicular to outer vertical leg 4.

The numeral 11 designates a vertical wall member which is connected to the lower side of conventional base roof deck 2'×4' portion 5. The numeral 12 designates the roof insulation portion of the roof deck. The numeral 13 designates a single-ply waterproof roofing membrane. Round stone ballast 14 may be placed on membrane 13 as desired. Membrane 13 is laid over cant flange 9, leg portion 8, and over vertical leg 4, terminating at a level, 15, below the bottom of the 2"×4" member 5. Membrane 13 may be formed from any flexible waterproof materials having good resistance to penetration, such as EPDM, which is an ethylenepropylenediene polymer; other natural and synthetic rubbers, such as a butadiene polymer; or other synthetic polymeric materials such as polyethylene. Many such membranes are commercially available.

Optionally, cant 3 may be supported by a wood block support 16, shown in dotted lines, although such support is not needed with the present system.

Fascia member 1 comprises vertical side portion 17, with its lower edge bent downwardly and outwardly to provide inclined flange 18. At the lower outer end of inclined flange 18 is an integrally formed folded over or U-shaped portion 19 and integral flange 20 which slopes upwardly and inwardly. Flanges 18 and 20 and U-shaped portion 19 comprise a channel which is adapted to receive and engage flange 7 on the lower end of cant outer vertical leg 4.

Integrally connected with the top end of vertical side portion 17 and forming an acute angle therewith is an inwardly and downwardly inclined leg portion 21. The acute angle described at junction 22 of leg portion 21 and vertical side portion 17 is preferably about 75°.

Fascia member 1 further includes a second inclined leg portion 23 which inclines downwardly and inwardly relative to leg portion 21 and is integrally connected thereto. Second leg portion 23 forms an angle with leg portion 21 at junction 24. The angle described at junction 24 of leg portion 21 and second leg portion 23 is preferably about 95°. However, when alternate pressure clip configurations are employed, such as those shown in FIGS. 5 and 6 herein, this angle is preferably an acute angle so as to bring second leg portion 23 in contact with the pressure clip. Second leg portion 23 terminates at its bottom end in a closed hem 25 formed by bending the bottom of second leg portion 23 inwardly at a 180° angle relative thereto.

Deformable pressure clip 2 is positioned between the upper portion of fascia vertical side portion 17, inclined leg portion 21 and second inclined leg portion 23, and cant leg portion 8 to compress and hold membrane 13 against the surface of cant leg portion 8. Pressure clip 2 comprises a first rising angular leg portion 26 terminating at its upper end 27 in contact with, and compressably held by, the inner acute angular surface of fascia junction 22. Leg portion 26 terminates at its lower end in an integral second leg portion 28 which extends inwardly and upwardly relative to the flat roof. The junction 29 between first leg portion 26 and second leg portion 28 is rounded to prevent cutting of membrane 13 by its outer surface which is in contact with and compressed against membrane 13. The angle between first leg portion 26 and second leg portion 28 is about 115° when pressure clip 2 is compressed as shown in FIG. 3, although this angle is about 105° before assembly of pressure clip 2 into the roof edge system of the invention.

Second leg portion 28 terminates at its upper end in an integral third leg portion 30 which inclines downwardly at an acute angle relative to second leg portion 28. The acute angle between second leg portion 28 and third leg portion 30 at junction 31 is about 80° when pressure clip 2 is compressed as shown in FIG. 3, although this angle is about b 75° prior to assembly of the system. Third leg portion 30 terminates in a downwardly and inwardly inclined flange 32, which forms an obtuse angle with third leg portion 30. This obtuse angle is preferably about 135°, and the angle is chosen so that flange 32 is parallel to the surface of cant leg portion 8 when the system is assembled as shown in FIG. 3. Flange 32 is in contact with and presses against the surface of membrane 13, holding membrane 13 against the outside surface of cant leg portion 8. The bottom of flange 32 is crimped to form a hem 33 by bending the bottom portion upwardly at a 180° angle relative to flange 32.

The roof edge system of the invention as shown in FIG. 3 is assembled by first attaching cant 3 to the roof substructure as described above. Membrane 13 is then installed as described above. Then pressure clip 2 is positioned under fascia member 1 as shown and direct downward pressure applied to the top of fascia member 1 near junction 22 until the U-shaped bottom (18, 19, 20) of fascia member 1 engages and holds cant "kick-out" 7 in the manner shown in FIG. 3.

The assembly can be readily disassembled for repairs or renovation by applying direct downward pressure on the top of the fascia in the same manner as was used for assembly until the U-shaped bottom (18, 19, 20) of fascia member 1 releases cant "kick-out" 7.

In the event water should build up on the roof following assembly of the system and in some manner become forced under the pressure clip (a very unlikely event), the water will flow over the top of the membrane and down the side of the building, completely protecting the roof substructure from water damage.

Figure 4:
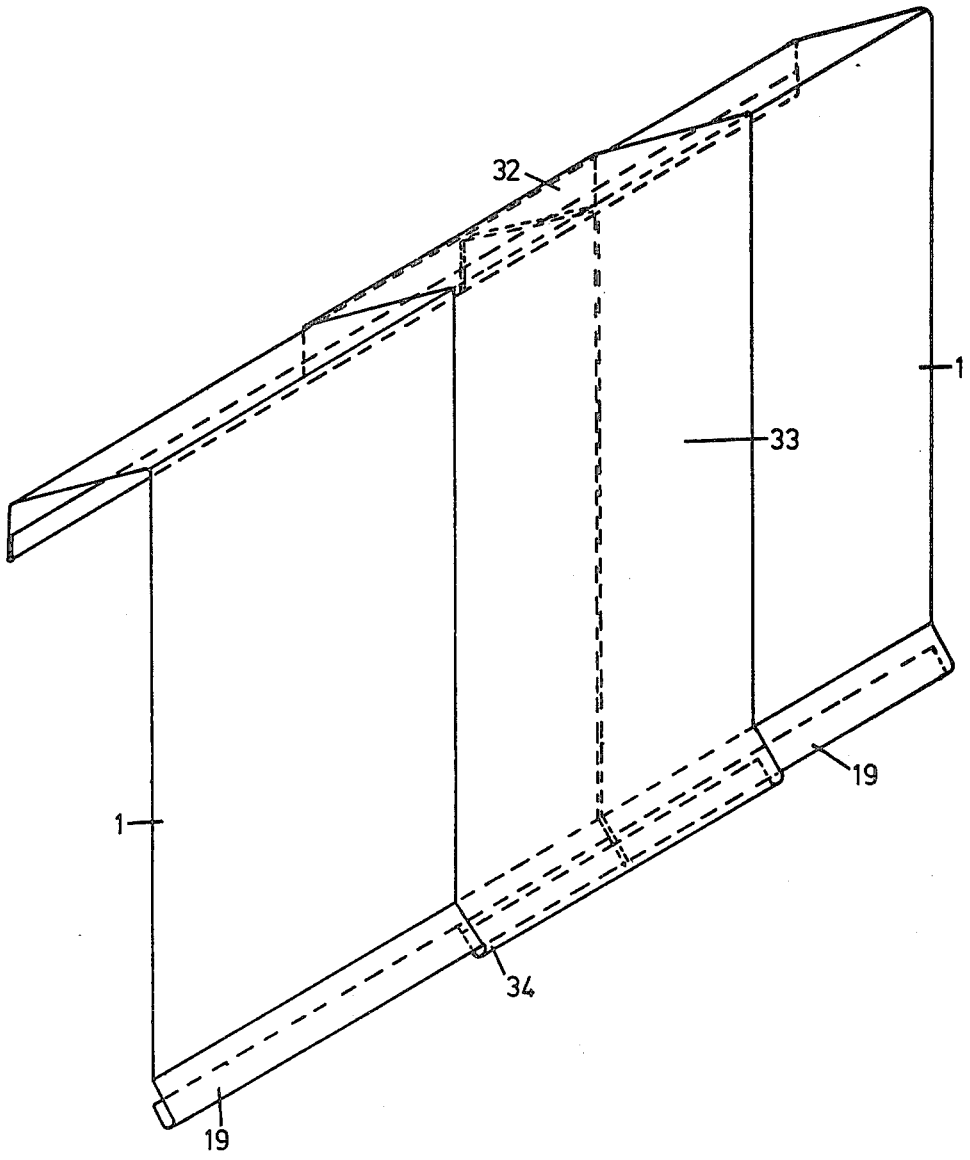
FIG. 4 shows two lengths of the fascia member used in the roof edge system of the invention with a fascia cover plate over the two fascia lengths.

FIG. 4 shows two sections of fascial with joint 34 at the junction between the two fascia sections, covered with fascia cover plates 35. Cover plates 35 can be formed in any convenient width, normally about 6" wide, and the inside of the cover plate can be caulked and/or the joint 34 can be caulked to provide further insurance that the assembly is and will remain waterproof. Cover plate 35 is formed in the same general design as is fascia member 1, except that cover plate 35 is formed slightly larger so that it can fit over and lock onto the ends of both fascia members 1, using a U-shaped portion 36 at the bottom end of cover plate 35 which is adapted to fit over the U-shaped portions 19 of the fascia members 1. Cover plate 35 is installed by hooking U-shaped portion 34 onto the U-shaped portions 19 of fascia members 1, centering cover plate 35 over joint 34, and pressing the top of cover plate 35 into place over the top section of fascia members 1.

Alternatively, cover plate 35 can be formed slightly smaller than fascia members 1 to fit under rather than over the two fascia sections.

FIGS. 5 through 8 show alternate configurations for the pressure clip, although it is understood that these configurations are not necessarily the only alternate configurations for a pressure clip that will be operable in the present system. FIG. 5 shows a generally "U" shaped pressure clip 37. FIG. 6 shows a "U" shaped pressure clip 38 having a flatened bottom section 39. FIG. 7 shows a "W" shaped pressure clip 40. FIG. 8 shows a "J" shaped pressure clip 41.

What is claimed is:

1. In an edge structure for a flat roof having a substructure and having thereon a waterproof covering membrane, the combination comprising:

(a) a cant having (i) an outer vertical portion having a first section thereof which extends above the roof and a second section thereof which extends below the roof and which is secured to the outer edge of the roof substructure, and (ii) an inner portion which is inclined inwardly and downwardly to the roof and which is secured to the roof (b) a fascia member having (1) an outer vertical portion extending above and below the roof, said outer vertical portion positioned parallel to the cant outer vertical portion, and having a lower end releasably engaged with said second section of the cant outer verical portion, (ii) an upper portion inclined inwardly and downwardly and having an upper surface and a lower surface, and (iii) a downward side portion describing an angle with said upper portion; and (c) a deformable pressure clip held in a compressed relationship between said fascia member and the cant inner portion to hold a waterproof covering membrane firmly in place between the cant inner portion and the pressure clip wherein the pressure clip makes contact with the lower surface of the upper portion of the fascia member (b) (ii) in at least two discrete locations thereon.

2. The roof edge structure in accordance with claim 1 in which said deformable pressure clip makes contact with the lower surface of the upper portion of the fascia member at three discrete locations thereon.

3. The roof edge structure in accordance with claim 1 or 2 in which said deformable pressure clip makes contact with the waterproof covering membrane at two discrete locations thereon.

4. The roof edge structure in accordance with claims 1 or 2 wherein the end of said waterproof membrane extends downward over the outer vertical portion of the cant to a level below the level of the roof substructure.

5. The roof edge structure in accordance with claim 1 in which said deformable pressure clip makes contact with the waterproof covering membrane at a single location thereon.

6. The roof edge structure in accordance with claim 1 in which said deformable pressure clip also makes contact with said side portion (b) (iii) of the fascia member.

7. The roof edge structure in accordance with claim 1 wherein the downward side portion of the fascia member has an end which is formed with a closed hem.

8. The roof edge structure in accordance with claim 1 wherein the deformable pressure clip has a lower end which is formed with a closed hem.

9. The roof edge structure in accordance with claim 1 wherein each member of the structure is formed in lengths of from about eight feet to about fourteen feet.

10. The roof edge structure in accordance with claim 1 wherein both the cant and the pressure clip are formed from galvanized steel sheets, and the fascia member is formed from an aluminum metal sheet.

11. The roof edge structure in accordance with claim 1 wherein the lower end of the outer vertical portion of the fascia member (b) (i) is adapted to be both coupled and uncoupled by direct downward pressure on the top of the fascia member.

12. The roof edge structure in accordance with claim 1 wherein the angle between the outer vertical portion and the upper portion of the fascia member is about 75°, and the angle between the upper portion and the side portion of the fascia member is about 95°.

13. The roof edge structure in accordance with claim 1 wherein the joints between sections of the fascia member are protected by a fascia cover plate.

14. An edge structure for a flat roof in accordance with claim 1 wherein the pressure clip (c) is substantially "J" shaped.

15. An edge structure in accordance with claim 1 wherein the pressure clip is substantially "U" shaped.

16. An edge structure in accordance with claim 1 wherein the pressure clip is substantially "U" shaped wherein the "U" has a flatened bottom portion.

17. An edge structure in accordance with claim 1 wherein the pressure clip is substantially "W" shaped.

18. The roof edge structure in accordance with claim 1 wherein pressure clip (c) has four leg portions formed from three bends therein wherein the first bend forms a second end of the first leg portion and a first end of the second leg portion, and the angle therebetween is an obtuse angle and wherein the first leg portion terminates in a first end thereof; the second bend forms a second end of the second leg portion and a first end of the third leg portion, and the angle therebetween is an acute angle, and the third leg portion extends away from the first leg portion, and said second bend has an inside surface and an outside surface; the third bend forms a second end of the third leg portion and a first end of the fourth leg portion, which fourth leg portion terminates in a second end thereof, and the angle beween the third and fourth leg portions is an obtuse angle; and said pressure clip is positioned so that the outside surface of the second bend and the first end of the fourth leg portion both contact the lower surface of the upper portion of facia member (b) (ii).

19. The roof edge system in accordance with claim 18 wherein the angle between the first leg portion and the second leg portion is about 105°; the angle between the second leg portion and the third leg portion is about 75°; and the angle between the third leg portion and the fourth leg portion is about 135°.

* * * * *

UNITED STATES PATENT AND TRADEMARK OFFICE

CERTIFICATE OF CORRECTION

PATENT NO. : 4,483,112

DATED : November 20, 1984

INVENTOR(S) : Carl R. Rueblinger

It is certified that error appears in the above-identified patent and that said Letters Patent are hereby corrected as shown below:

In figure 4 of the drawings, for the numeral "32" substitute the numeral ---35---;for the numeral "33" substitute the numeral ---34---;for the numeral "34" substitute the numeral ---36---

Column 4, line 29 for "component" substitute ---components---

Column 5, lines 34,40, and 48, the numeral "5" should be in bold face type.

Column 6, line 58 for "about b75°" substitute ---about 75°---
(with 75° in standard, not bold face, type).

Claim 1, line 64 for "(1)" substitute--- (i)---

Claim 19, line 3 for "105°" substitute ---115°---
line 4 for "75°" substitute ---80°---

Signed and Sealed this

*Thirty-first* Day of *December 1985*

[SEAL]

*Attest:*

DONALD J. QUIGG

*Attesting Officer*

*Commissioner of Patents and Trademarks*